US005392054A

United States Patent [19]

Bottomley et al.

[11] Patent Number: 5,392,054

[45] Date of Patent: Feb. 21, 1995

[54] DIVERSITY ANTENNA ASSEMBLY FOR PORTABLE RADIOTELEPHONES

[75] Inventors: Gregory E. Bottomley, Cary; Edward Smith, Raleigh, both of N.C.

[73] Assignee: Ericsson GE Mobile Communications Inc., Research Triangle Park, N.C.

[21] Appl. No.: 11,228

[22] Filed: Jan. 29, 1993

[51] Int. Cl.[6] ..... H01Q 1/24

[52] U.S. Cl. ..... 343/702; 343/725

[58] Field of Search ..... 343/702, 725, 715, 900, 343/915, 853, 880; 455/89, 90, 347

[56] References Cited

U.S. PATENT DOCUMENTS 4,728,962 3/1988 Kitsuda et al. ..... 343/702

4,816,838 3/1989 Mizuno et al. ..... 343/702

5,014,346 5/1991 Phillips et al. ..... 455/89

5,138,328 8/1992 Zibrik et al. ..... 343/702

5,138,651 8/1992 Sudo ..... 455/89

*Primary Examiner*—Donald Hajec

*Assistant Examiner*—Tan Ho

*Attorney, Agent, or Firm*—Nixon & Vanderhye

[57] ABSTRACT

A diversity antenna assembly for use with portable radiotelephones includes plural antennas physically connected by a non-conducting member to effect simplicity of deployment of the antenna assembly. The antennas are spatially separated to provide space diversity to minimize the deleterious effects of Rayleigh fading.

35 Claims, 3 Drawing Sheets

DIVERSITY ANTENNA ASSEMBLY FOR PORTABLE RADIOTELEPHONES

FIELD OF THE INVENTION

The present invention relates to a diversity antenna, and more particularly, to a diversity antenna structure for use in portable radiotelephones.

BACKGROUND AND SUMMARY OF THE INVENTION

Rayleigh fading is a phenomenon associated with radio communications where multiple reflections of a transmitted signal constructively and destructively superpose at points in space according to the relative phase and amplitude of all the reflected signals. This spatial interaction of multipath signals produces both strong peaks (local maximums) and deep nulls (local minimums) of relative signal strength with regard to varying position. Often the fading can result in signal "holes" where the signal strength will drop below a minimum threshold of reception of a radio receiver, e.g. a mobile radiotelephone. Depending on the relative phase of the interacting signals, the peaks and nulls of signal strength are generally separated by a fraction of the free space wavelength of the carrier frequency of the transmitted signal. These signal strength fluctuations present a significant and challenging problem particularly in the mobile radio communications environment.

One mechanism which addresses the problems of Rayleigh fading is a space diversity technique where two or more antennas are separated by a minimum of one half of a wavelength of carrier frequencies to be received. At UHF frequencies, for example, a deep signal fade can be overcome by moving the antenna only a few inches. By separating two antennas by the appropriate distance, each antenna receives a signal whose fading pattern is uncorrelated with the fading pattern of the signal received by the other antenna. Improved signal reception is then achieved simply by programming the receiver to select (using one or more conventional techniques) the antenna with the strongest signal. More sophisticated techniques combine the signals from both antennas.

Recently, space diversity antennas have been considered for use on portable radiotelephones. For a telephone installed in an automobile which moves rapidly in and out of signal fades, Rayleigh fading is usually a transient and therefore tolerable occurrence. However, handheld portable radiotelephones are often operated with relatively slow moving (even stationary) characteristics such that if a user is positioned at a "deep null". reception (if any) is poor. Consequently, Rayleigh fading is particularly troublesome for portable radiotelephones.

Unfortunately, the dimensions of a portable radiotelephone, being comparable to that of a fraction of the free space wavelength at UHF frequencies, make the addition of a plurality of antennas difficult. A great selling point of portable telephones is of course their compact size and sleek appearance. Adding two antennas to a compact and sleek structure without adversely impacting these characteristics is a difficult task. In fact, the resulting ungainly appearance and inconvenient deployment of two antennas are primary reasons that in spite of the statistical improvement to signal reception by reducing sensitivity to Rayleigh fading provided with spatial diversity, most consumers dislike the appearance of diversity antennas on a portable radiotelephone.

One approach to overcome this appearance problem is to install two antennas within the body of the radiotelephone. Although this approach suitably addresses the problem of consumer appeal and convenience, it requires the use of compact antennas which suffer from reduced gain, and therefore, poor signal reception. Further, antennas installed in the body of the portable radiotelephone are typically blocked by the user's hand or head while listening or talking.

It is therefore an object of the present invention to provide for an improved diversity antenna for use in a portable radiotelephone which offers both high gain, consumer convenience, and an appealing appearance. It is another object of the present invention to provide for an improved diversity antenna for use in a portable radiotelephone that is not blocked by the user's head or hand. It is yet a further object of the present invention to provide for a diversity antenna for use in a portable radiotelephone that can be easily deployed in a single motion.

An adjustable diversity antenna assembly for use with a portable radiotelephone includes a plurality of antennas connected at one end to the portable radiotelephone for receiving radio frequency signals. A non-conductive member connects and spaces the plurality of antennas in a deployed position to reduce Rayleigh fading effects. The antennas are spaced apart in their deployed position by the connecting member which has a length essentially the same as some fraction, e.g. a quarter, of the wavelength of the received radio frequency signals.

The connecting member is used to deploy and stow the antenna assembly on the portable radiotelephone from an extended deployed position to a compact stowed position. Moreover, the diversity antenna assembly may be stowed in a cavity formed in the body of the portable radiotelephone.

The member and the plurality of antennas may be formed as an integral body made of molded plastic which forms the member and encases the antennas. In one embodiment, the integral body is a rotatably connected cover for covering a front face of the radiotelephone when the antenna assembly is stowed. In another embodiment, each of the antennas is a telescoping antenna which is moved to the deployed position by pulling the member away from the radiotelephone and stowed by pushing the member toward the radiotelephone.

In another embodiment, the portable radiotelephone according to the present invention includes a transceiver and a plurality of antennas connected to the transceiver for receiving transmitted signals. An axially adjustable non-conductive member connects the plurality of antennas. Means are included for laterally extending at least one of the plurality of antennas.

BRIEF DESCRIPTION OF THE DRAWINGS

These and other objects, features and advantages of the present invention will be apparent from the following more detailed description of the preferred embodiments as illustrated in the accompanying drawings in which like reference numerals refer to like elements throughout the drawings.

DETAILED DESCRIPTION OF THE DRAWINGS

Figure 1A:
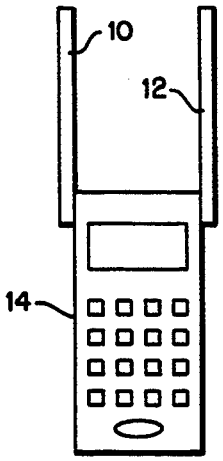
FIGS. 1(*a*)–1(*c*) show possible arrangements for diversity antennas for use with portable radiotelephones.
Figure 1B:
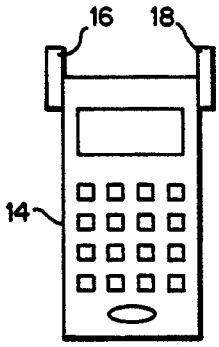
Figure 1C:
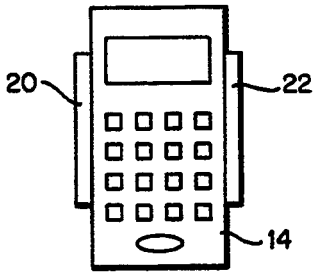

FIGS. 1(*a*)–1(*c*) illustrate possible approaches to the problem of installing diversity antennas on portable radiotelephones. FIG. 1(*a*) shows two fixed length whip antennas 10 and 12 connected to a portable radiotelephone 14, where each antenna must be separately moved to a deployed position (illustrated). This approach permits the use of high gain antennas but is quite inconvenient and awkward. A more convenient configuration shown in FIG. 1(*b*) uses stub antennas 16 and 18 which do not have to be extended or retracted. Stub antennas 16 and 18 unfortunately offer significantly reduced gain as compared to the longer whip antennas 10 and 12. The antenna configuration shown in FIG. 1(*c*) installs compact antennas 20 and 22 (shorter than whip antennas 10 and 12 but longer than stub antennas 16 and 18) on opposing sides of the telephone body 14. While this approach improves appearance and user convenience, it suffers from both poor antenna placement, e.g. the user's hand and head block the antennas' reception path, and reduced gain from the compact antennas. Thus, all three diversity antenna approaches have undesirable effects in the context of a portable radiotelephone.

Figure 2A:
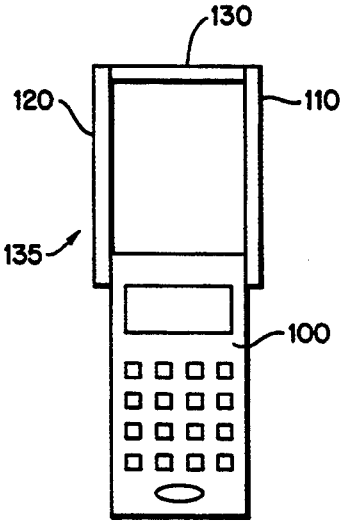
FIGS. 2(*a*)–2(*c*) show a preferred embodiment of the present invention as used in conjunction with a portable radiotelephone.
Figure 2B:
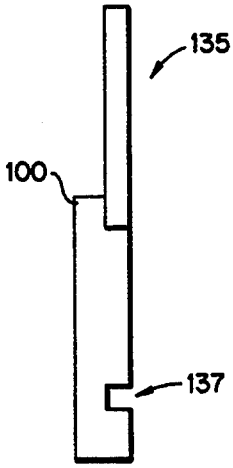
Figure 2C:
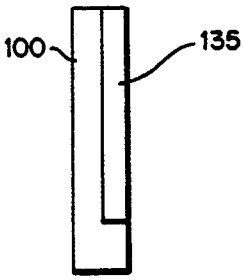

The drawbacks of these approaches are obviated by a preferred embodiment of the present invention illustrated in FIGS. 2(*a*)–2(*c*). A non-conductive member 130 connects, e.g. by suitable fastener or bonding mechanism, the top ends of whip received antennas 110 and 120. The non-conductive connecting member 130 may be made of any relatively rigid material that is non-conductive, e.g. molded plastic. The base ends of antennas 110 and 120 are attached to opposing sides of a portable radiotelephone 100, preferably near the top of the telephone body. The base ends of the antennas 110 and 120 are electrically coupled to the transceiver in the portable radiotelephone 100 either directly, e.g. by wire cable, or indirectly, by capacitive coupling.

The two antennas 110, 120 and the non-conductive connecting member 130 together comprise a diversity antenna assembly 135 that may be moved to a deployed position (shown in FIG. 2(*a*)) as an integral unit by a user, e.g. to place a call, in a single motion. FIG. 2(*b*) illustrates a side view of the radiotelephone 100 with the antenna assembly 135 deployed.

Preferably, the entire antenna assembly 135 is formed as an single integral piece, e.g. in molded plastic. That molded plastic assembly encases the antennas 110 and 120, forms the connecting member 130, and provides structural support and protection to the antennas when a user deploys and stows the antenna assembly 135.

The base ends of the antennas 110 and 120 may be rotatably connected to axially rotatable connectors (not shown) mounted or formed on opposing sides of the portable radio telephone body 100 which permit the diversity antenna assembly 135 to be rotated about those connectors by at least 180 degrees. While not shown, the antennas 110 and 120 could also be connected flush with the side surfaces of the radiotelephone 100. In a stowed position shown in the side view of FIG. 2(*c*), the diversity antenna assembly 135 is rotated to align with the telephone body 100. This arrangement has the benefit that the stowed antenna assembly 135 does not protrude from the telephone body 100. Preferably, the telephone body 100 could be molded to include one or more cavities or grooves 137 in its back and/or side surface(s) to stow the antenna assembly 135 flush with the portable telephone body 100. Depending on the length of the antennas 110 and 120, the width of the connecting member 130 could be made sufficiently wide so that when the antenna assembly 135 is rotated 180 degrees from its fully deployed position, i.e. under the base of the telephone body 100, a user could rest the portable telephone 100 on the connecting member 130. In addition, antenna assembly 135 may be rotated to an angle from its stowed position to function as a stand for the telephone body 100.

In operation, a user deploys the diversity antenna assembly 135 from its stowed position simply by grasping the connecting member 130 with one hand and moving the antenna assembly to a deployed position extending from the top of the portable telephone body 100. In the deployed position as shown in FIG. 2(*a*), the antennas 110 and 120 are not blocked by the user's hand holding the telephone 100 or the user's head.

The length of the connecting member 130 is set to some desirable fraction of the wavelength, i.e. a quarter wavelength, of the carrier RF frequencies that the portable radiotelephone 100 is to receive to mitigate the effects of Rayleigh fading. In addition to assuring that the antennas 110 and 120 have the required space diversity, the connecting member 130 also provides lateral support to the antenna assembly 135 and allows both antennas to be deployed to the same length, e.g. a half wavelength of the received carrier frequencies.

Although this embodiment of the present invention envisions a rotatable connection of the antenna assembly 135 to the telephone body 100, those skilled in the art will appreciate that the antenna assembly 135 could also be slidably connected to tracts or grooves (not shown) on the sides of the portable telephone body 100. The user would simply pull the connecting member 130 up to deploy the antenna assembly along the tract or groove to a fully extended position and then push the connecting member 130 down to stow the antenna assembly 135.

Figure 3A:
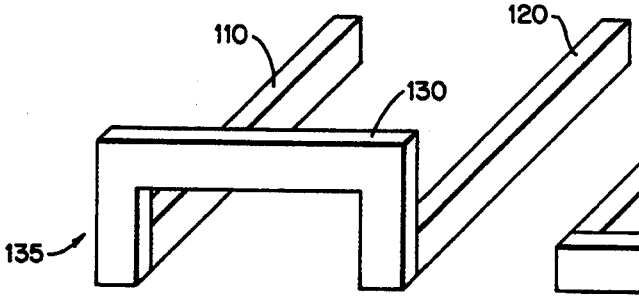
FIGS. 3(*a*) and 3(*b*) illustrate diversity antennas according to a preferred embodiment of the present invention.
Figure 3B:
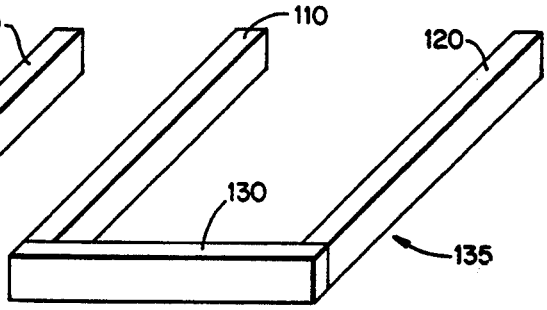

FIGS. 3(*a*) and 3(*b*) illustrate various exemplary shapes for the connecting member 130. FIG. 3(*a*) shows a U-shaped connecting member 130 which extends perpendicularly from the two antennas 110 and 120. Such a U-shaped member may be more convenient in some portable telephone designs for deploying or stowing the diversity antenna assembly 135. The non-conductive connecting member 130 however is typically a straight, bar-shaped member as illustrated in FIG. 3(*b*). The connecting member 130 may be configured in any desirable fashion, e.g. angled, to accommodate particular features of the radiotelephone body 100.

Figure 4A:
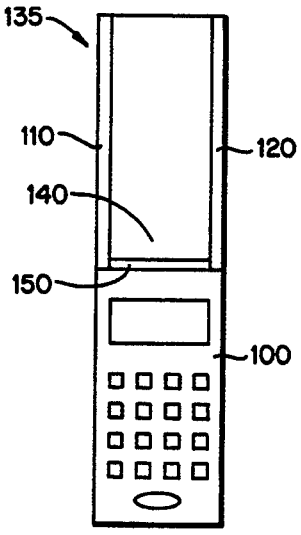
FIGS. 4(*a*)–4(*c*) are front and side views of an alternate embodiment of the present invention.
Figure 4B:
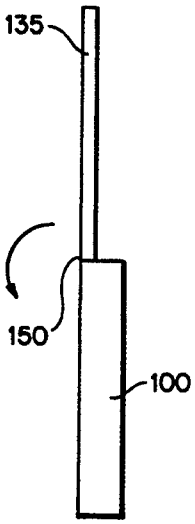
Figure 4C:
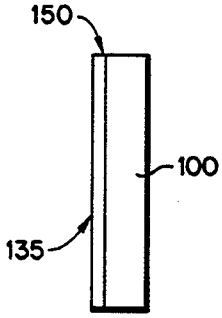

An alternate embodiment of the present invention is illustrated in FIGS. 4(*a*)–4(*c*). FIG. 4(*a*) is a front view of the portable radiotelephone 100 and diversity antenna assembly 135. Antennas 110 and 120 are integrated into a non-conductive planar member such as a cover 140 for protecting the face of the portable telephone 100. The cover 140 may be any suitable non-conductive rigid material, e.g. plastic, and connects to the top end of the radiotelephone body by a hinge 150 or other rotatable fastener. The antennas 110 and 120 may be connected electrically and mechanically as described above to accommodate the hinged movement of the cover 140.

FIG. 4(*b*) shows a side view of the portable radiotelephone 100 with the diversity antenna assembly 135 in the deployed position. The side view also reveals that the hinge 150 is positioned near the front face of the portable radiotelephone body 100 for easy rotation of the diversity antenna assembly 135 about the hinge 150. FIG. 4(*c*) shows a side view of the portable radiotelephone 100 with the diversity antenna assembly 135 rotated to a stowed position covering the front face of the telephone 100. Thus, the rigid cover 140 offers an additional benefit of protecting the front face of the portable radiotelephone 100 when it is not in use.

Figure 5A:
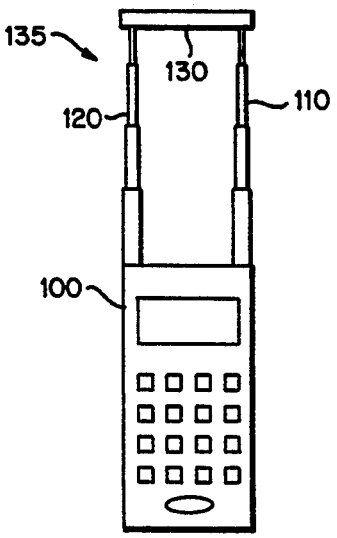
FIGS. 5(*a*) and 5(*b*) illustrate a further alternate embodiment of the present invention.
Figure 5B:
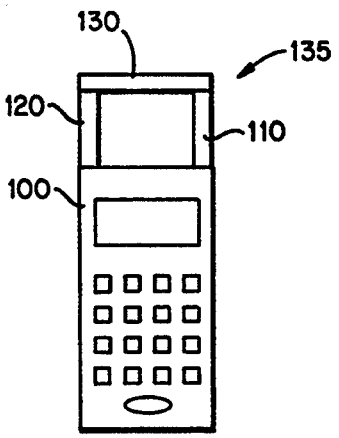

Another alternate embodiment of the present invention is illustrated in FIGS. 5(*a*) and 5(*b*). FIG. 5(*a*) shows the two antennas 110 and 120 as telescoping type antennas in their deployed position, i.e. fully extended. As in previously described embodiments, the connecting member 130 is attached at its ends to the respective top portions of the telescoping antennas. The antennas may be readily stowed, as illustrated in FIG. 5(*b*), simply by pressing down on the connecting member 130. The telescoping antennas provide relatively high gain when deployed and compact size when stowed.

Figure 6A:
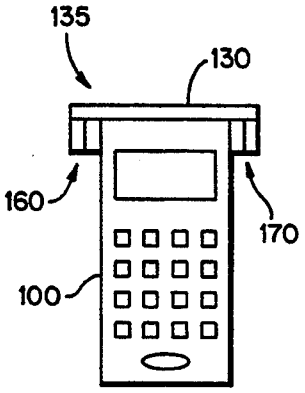
FIGS. 6(*a*)–6(*c*) are front views of yet another alternate embodiment of the present invention.
Figure 6B:
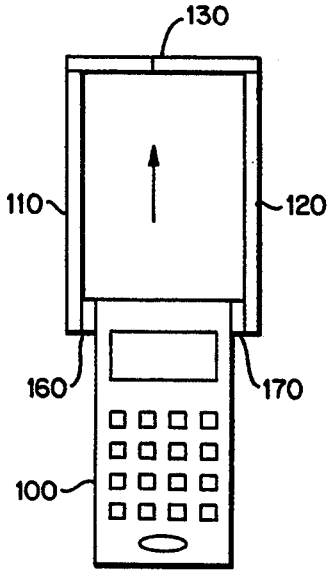
Figure 6C:
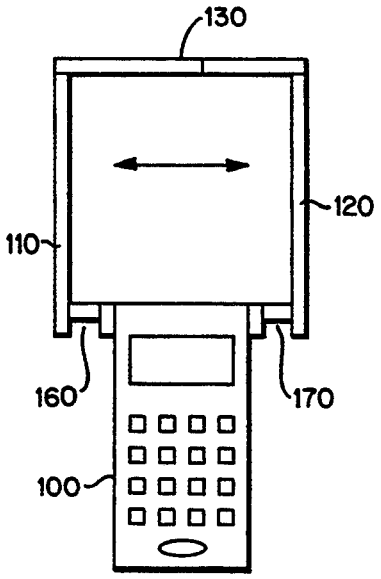

Yet a further alternate preferred embodiment of the present invention is described in conjunction with FIGS. 6(*a*)–6(*c*) which show an adjustable diversity antenna assembly 135 where the spacing between the individual antennas may be increased to achieve antenna diversity. This flexible arrangement may be required where, due to particularly slim portable radiotelephone dimensions, the antennas must be laterally extended from the body 100 to maximize the gain provided by space diversity.

From the stowed position shown in FIG. 6(*a*), the diversity antenna assembly 135 is deployed in two stages. First and as shown in FIG. 6(*b*), the connecting member 130 is lifted to either extend a telescoping antenna pair (as shown in FIG. 5) or rotate a fixed length antenna pair (as shown in FIGS. 2 and 4). Second, a pair of sliding joints 160 and 170 connecting the base ends of the antennas to the sides of the radiotelephone body 100 permit the antennas 110 and 120 to be pulled apart and away from the telephone body 100, as illustrated in FIG. 6(*c*). The connecting member 130 may be constructed to be axially extendable and retractable, e.g. in the manner of the telescoping antennas shown in FIG. 5. The reverse sequence of course is used to stow the antenna assembly 135. Thus, even though future portable radiotelephones may become more compact in size and assigned carrier frequencies may change, the antenna assembly of the present invention provides the necessary flexibility to achieve space diversity.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An adjustable diversity antenna assembly for use with a portable radiotelephone comprising:

a plurality of receive antennas being spaced to reduce the effects of Rayleigh fading and allowing diversity reception, the antennas connected at one end to the portable radiotelephone for receiving radio frequency signals and being movable between a deployed position and a stowed position; and a nonconductive member for interconnecting and maintaining the spacing of the plurality of receive antennas when in the deployed position.

2. A diversity antenna assembly according to claim 1, wherein the member is used to deploy and stow the antenna assembly on the portable radiotelephone.

3. A diversity antenna assembly according to claim 1, wherein the member and the plurality of antennas are formed as an integral body.

4. A diversity antenna assembly according to claim 3, wherein the integral body is made of molded plastic which forms the member and encases the antennas.

5. A diversity antenna assembly according to claim 3, wherein the integral body is a cover for covering a front face of the radiotelephone when the antenna assembly is stowed.

6. A diversity antenna assembly according to claim 5, wherein the cover is rotatably connected to the radiotelephone by a hinge.

7. A diversity antenna assembly according to claim 1, wherein the antenna assembly is retractable from an extended deployed position to a compact stowed position.

8. A diversity antenna assembly according to claim 7, wherein in the compact stowed position the antenna assembly is flush with the portable radiotelephone.

9. A diversity antenna assembly according to claim 1, wherein the diversity antenna assembly is stowed in a cavity in the body of the portable radiotelephone.

10. A diversity antenna assembly according to claim 1, wherein the member is U-shaped.

11. A diversity antenna assembly according to claim 1, wherein member is planar in shape.

12. A diversity antenna assembly according to claim 1, wherein the member connects to one end of each of the antennas and the other end of each of the antennas connects to the portable radiotelephone.

13. A diversity antenna assembly according to claim 1, wherein each of the antennas is rotatably connected to the radiotelephone such that the antenna assembly is rotatably deployed and stowed.

14. A diversity antenna assembly according to claim 13, wherein the member is used to move the antenna assembly.

15. A diversity antenna assembly according to claim 1, wherein the antennas are telescoping antennas moved to the deployed position by pulling the member away from the radiotelephone and stowed by pushing the member toward the radiotelephone.

16. A diversity antenna assembly according to claim 1, wherein each of the antennas is laterally extendable in the deployed position.

17. A diversity antenna assembly according to claim 1, wherein the antennas are spaced apart in the deployed position by a fraction of the wavelength of the received radio frequency signals.

18. A portable radiotelephone comprising:

a housing;

a transceiver;

a plurality of antennas connected to the transceiver for receiving transmitted signals;

means for laterally extending from a stowed position to a deployed position one of the plurality of antennas from a side of the portable radiotelephone housing; and an axially adjustable nonconductive member interconnecting the plurality of the antennas, said member separate from the housing of the portable radiotelephone, wherein the plurality of antennas, the means for extending, and the member form an antenna assembly.

19. A portable radiotelephone according to claim 18, wherein the member is used in conjunction with the means for laterally extending to deploy and stow the antenna assembly on the portable radiotelephone.

20. A portable radiotelephone according to claim 18, wherein the antenna assembly is retractable from an extended deployed position to a compact stowed position.

21. A portable radiotelephone according to claim 20, wherein in the compact stowed position the antenna assembly is flush with the portable radiotelephone.

22. A portable radiotelephone according to claim 18, wherein the antenna assembly is stowed in a cavity in the body of the portable radiotelephone.

23. A portable radiotelephone according to claim 18, wherein the member connects to one end of each of the antennas and the other end of each of the antennas connects to the portable radiotelephone.

24. A portable radiotelephone according to claim 18, wherein each of the antennas is rotatably connected to the radiotelephone.

25. A portable radiotelephone according to claim 24, wherein the member is used to rotate the antenna assembly.

26. A portable radiotelephone according to claim 18, wherein the antennas are telescoping antennas which are moved by pulling the member away from the radiotelephone and by pushing the member toward the radiotelephone.

27. A portable radiotelephone according to claim 18, wherein the antennas are spaced apart in the deployed position by a fraction of a wavelength of the received signals, the member being adjustable to a length essentially the same as the quarter wavelength.

28. A portable radiotelephone according to claim 18, wherein the space between the antennas may be adjusted by moving the antennas together or apart.

29. In a wireless communication system, a portable radiotelephone having a diversity antenna assembly comprising:

plural antennas for receiving radio frequency signals spaced apart to provide diversity reception and to reduce the effects of Rayleigh fading, and a non-conductive cover rotatably connected to the portable radiotelephone for covering a front surface of the portable radiotelephone wherein the plural antennas are formed as part of the cover.

30. A portable radiotelephone according to claim 29, wherein the antennas are spaced apart by a predetermined distance to minimize Rayleigh fading effects on the received signals.

31. A portable radiotelephone according to claim 29, wherein the antennas are spaced apart by a fraction of a wavelength of the received radio frequency signals.

32. A portable radiotelephone according to claim 29, wherein the non-conductive cover is hinged to the body of the portable radiotelephone.

33. A portable radiotelephone according to claim 29, wherein a user deploys and stows the antenna assembly by rotating the cover.

34. A portable radiotelephone according to claim 29, wherein the cover and the plurality of antennas are formed as an integral body.

35. A portable radiotelephone according to claim 34, wherein the integral body is made of molded plastic.

* * * * *